United States Patent [19]

Connell

[11] 4,080,105

[45] Mar. 21, 1978

[54] TIRE INFLATOR

[76] Inventor: Edwin E. Connell, 62-11 47th Place, Middle Village, N.Y. 11379

[21] Appl. No.: 750,886

[22] Filed: Dec. 15, 1976

Related U.S. Application Data

[63] Continuation-in-part of Ser. No. 595,383, Jul. 14, 1975, abandoned.

[51] Int. Cl.[2] ..... F04B 49/02; F04B 49/08; F16K 15/20; B60C 23/00

[52] U.S. Cl. ..... 417/26; 417/33; 417/38; 137/224; 152/415

[58] Field of Search ..... 417/38, 26, 415; 137/224; 152/415

[56] References Cited

U.S. PATENT DOCUMENTS

| | | | |
|---|---|---|---|
| 1,098,173 | 5/1914 | Ruff | 417/33 |
| 1,655,003 | 1/1928 | Woodford | 152/415 |
| 1,768,275 | 6/1930 | Urton | 137/224 |
| 1,789,746 | 1/1931 | Hoddon | 137/224 |
| 2,010,062 | 8/1935 | Dawson | 417/44 |
| 2,012,882 | 10/1935 | Brower | 137/224 |
| 2,173,369 | 9/1939 | McElroy | 137/224 |
| 2,610,235 | 9/1952 | Stella | 417/44 |
| 3,283,094 | 11/1966 | Lung | 417/44 |
| 3,576,379 | 4/1971 | Darise | 417/410 |
| 3,885,739 | 5/1975 | Tuttle | 417/33 |

*Primary Examiner*—William L. Freeh
*Attorney, Agent, or Firm*—Philip D. Amins

[57] ABSTRACT

An inflator for tires having a housing adapted to be hand held, with air compressor means including an electric motor mounted in the housing for supplying air under pressure to a tire. Adjustable valve means is mounted on the housing and operatively connected to the compressor means for selecting a predetermined air pressure for deliver to the tire, the valve means movable between open and closed positions. A hose is operatively connected to the valve means to provide air under pressure for delivery to the tire from the compressor means in the open position of the valve means, and switch means is mounted in the housing and coupled to the motor for supplying electrical energy to the motor in the energized position of the switch means. Actuating means is operatively associated with the valve means and the switch means, the actuating means releasing the switch means from its energized position when the closed position of the valve means is obtained when a predetermined pressure is reached in the valve means, such that the supply of compressed air to the tire ceases.

32 Claims, 7 Drawing Figures

34
44
24
12
42
42
46
32
150
40
174
176
154
156
38
142
37
180
176
166
170
38
172
152
168
158
192
164
202
144
190
184
186
190
204
200

34
44
24
40
12
46
48
32
150
174
156
158
38
142
162
160
168
182
37
180
166
170
172
152
38
154
192
176
164
202
144
184
190
186
190
204
200

TIRE INFLATOR

CROSS-REFERENCE TO RELATED APPLICATION

This application is a continuation-in-part of my copending application Ser. No. 595,383, filed July 14, 1975 now abandoned.

BACKGROUND OF THE INVENTION

The present invention relates to a hand-held, self-powered, automatically regulated inflator primarily for bicycle tires, delivering low volume at high pressure, and more particularly for maintaining correct air pressure in bicycle tires.

Although the present invention is hereinafter discussed as to its use for the filling of bicycle tires, it is appreciated that other items that require air under pressure to be inflated to a selected predetermined pressure may also be filled using the device of the present invention.

Bicycle owners face a common problem, that of keeping their tires properly inflated. All bicycle tires lose pressure constantly. A few days of storage results in pressure loss to the danger point. And the rate of pressure loss is much greater while riding. As every bicycle rider knows, the loss of even a few pounds pressure vastly increases the effort required to pedal the bicycle, reduces controllability, and results in short tread life and early destruction of the tires.

Over the years the mechanical components of bicycles have been vastly improved. Lightweight alloy steel frames, multiple speed chain drives, two wheel brakes. All of these make for bicycles that are easier to ride, more adaptable to varying terrain, and safer. But the basic problem of tire inflation remains unresolved. If anything, it has gotten more acute. This is due to the ever-increasing popularity of the narrow, high pressure tires used on the more sophisticated bicycles. In the earlier days of bicycling, these high pressure tires were a comparative rarity, used only by professionals on very expensive competition bicycles. This is no longer the case. Now almost every rider deeply involved in the sport insists upon owning one or more bicycles equipped with these high performance, high pressure tires.

There are two means of bicycle tire inflation commonly used. One is the automobile tire inflation hose found at filling stations. Not only is the source inconvenient, it may force the bicycle owner to "walk" his bicycle many blocks on soft tires to reach it. But it very often results in a classic example of "overkill." A split second's delay in removing the air chuck from the tire valve, and the tire is destroyed in one ear-splitting sound.

The other method in use is the hand pump. This method is safe, but physically demanding. In fact, it is considered so onerous a task that often bicycle owners will deliberately ride on soft, underinflated tires rather than go through the sweating, hand-blistering job of pumping them up to correct pressure.

As an example, the standard type of "tire pump" has a cylinder of 1¼ inches diameter. To reach an inflation pressure of 110 lbs. sq. in., which is demanded by the popular "racing type" tire, a force of 135 lbs. is required on the pump handle.

The telescopic type pump often found around bicyclists is slightly better, but not much. Unless the user has heavily calloused palms and arms of steel, he will very soon tire of this exertion. This procedure of pressure checking and reinflation is to be gone through every time the bicycle is to be used. Obviously, this is beyond the physical capabilities of children and the elderly. And these groups comprise a large sector of bicycle users.

OBJECTS OF THE INVENTION

An object of the present invention is to provide a new and novel inflator for tires that is adapted to be hand held by the user and having an automatic shutoff feature, when the preselected pressure is reached.

It is another object of the present invention to provide a portable tire inflator, ideally suitable for bicycle tires, having its own air compressor contained therein and with means for regulating the pressure to be supplied to the tire.

It is yet a further object of the present invention to provide a portable electrically powered air inflator having a novel actuating means for stopping the compressor when a preselected pressure level is reached.

Other objects and advantages of the present invention will become apparent as the disclosure proceeds.

SUMMARY OF THE INVENTION

An inflator for bicycle tires having a housing adapted to be hand held, with air compressor means including an electric motor mounted in the housing for supplying air under pressure to the tire. The motor is powered from a conventional source of electric current supplied by a line cord from an outlet.

Adjustable valve means is mounted on the housing and is operatively connected to the compressor means for selecting a predetermined air pressure for delivery to the tire. The valve means being movable between open and closed positions related to the pressure selected. A hose is operatively connected to the valve means to provide air under pressure for delivery to the tire from the compressor means in the open position of the valve means. Regulating means is operatively associated with the valve means to select the predetermined pressure for delivery to the tire.

Switch means is mounted in the housing and coupled to the motor for supplying electrical energy to the motor in the energized position of the switch means. A trigger is mounted on the housing and manually engageable by the user of the inflator for movement between a first and second position. The trigger is mechanically linked to the switch means and movable from the first position to the second position, with the switch means being energized in the second position.

Actuating means is operatively associated with the valve means, the trigger and the switch means. The actuating means releasing the trigger from the second position when the closed position of the valve means is obtained, such that when the predetermined pressure is reached in the valve means the supply of compressed air to the tire ceases.

BRIEF DESCRIPTION OF THE DRAWINGS

The foregoing and other objects, features, advantages and utilizations of the new and novel tire inflator device of the present invention will become more apparent from the detailed description hereinafter considered in conjunction with the accompanying drawings, wherein.

DETAILED DESCRIPTION OF THE DRAWINGS

Figure 1:
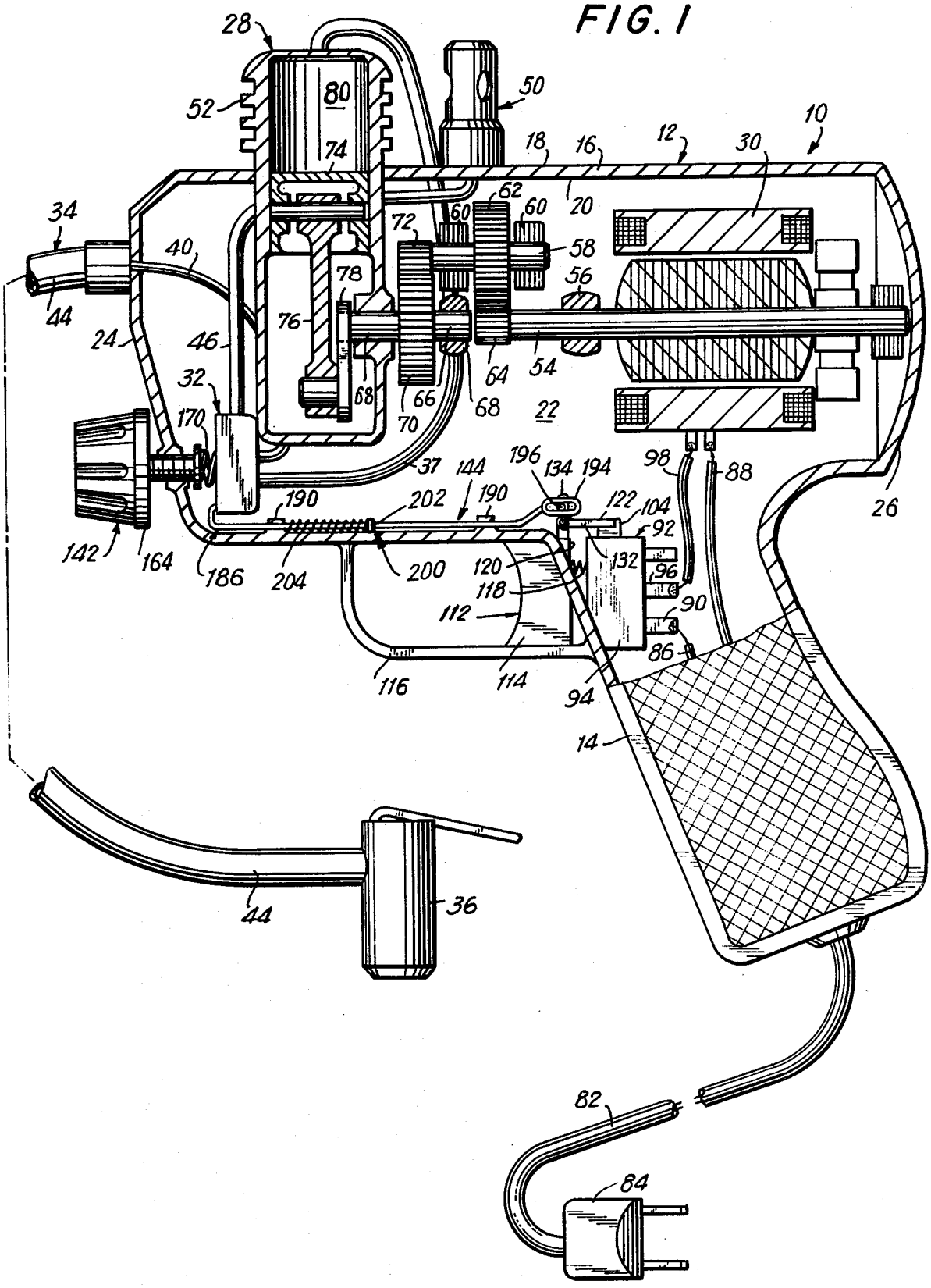
FIG. 1 is a side view, partly broken away and in section, illustrating the tire inflator of the present invention.

Referring to the drawings, there is illustrated in FIGS. 1 through 7 a preferred embodiment of the inflator 10 to be used for tires, or the like, in accordance with the present invention. The inflator 10 includes a housing 12 that may have a pistol-type handle 14 that is readily gripped by the user. The housing 12 has a housing wall 16 having an outer surface 18 and an inner surface 20 forming a cavity 22 for receiving various components of the inflator 10. The housing 12 includes a front wall 24 and spaced apart rear wall 26.

Figure 2:
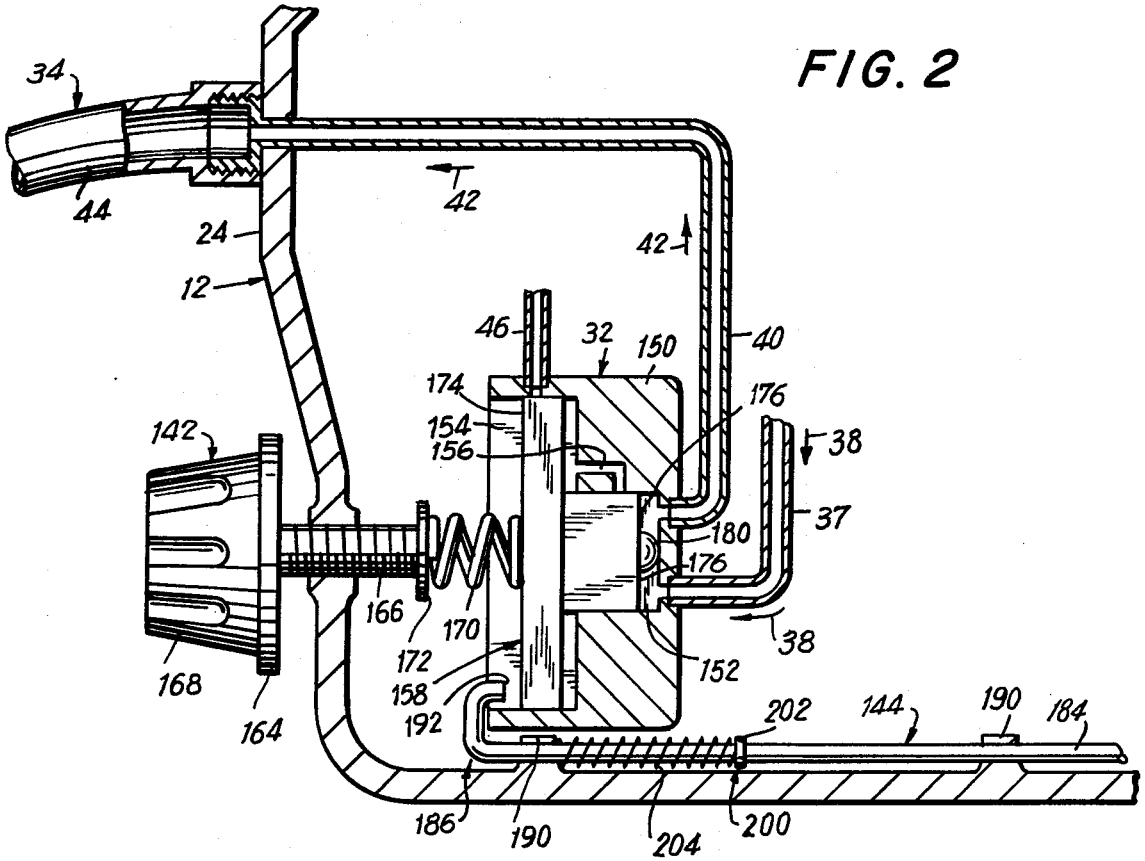
FIG. 2 is an enlarged fragmentary view, in section, illustrating the open position of the valve means to permit a flow of air to the tire.
Figure 3:
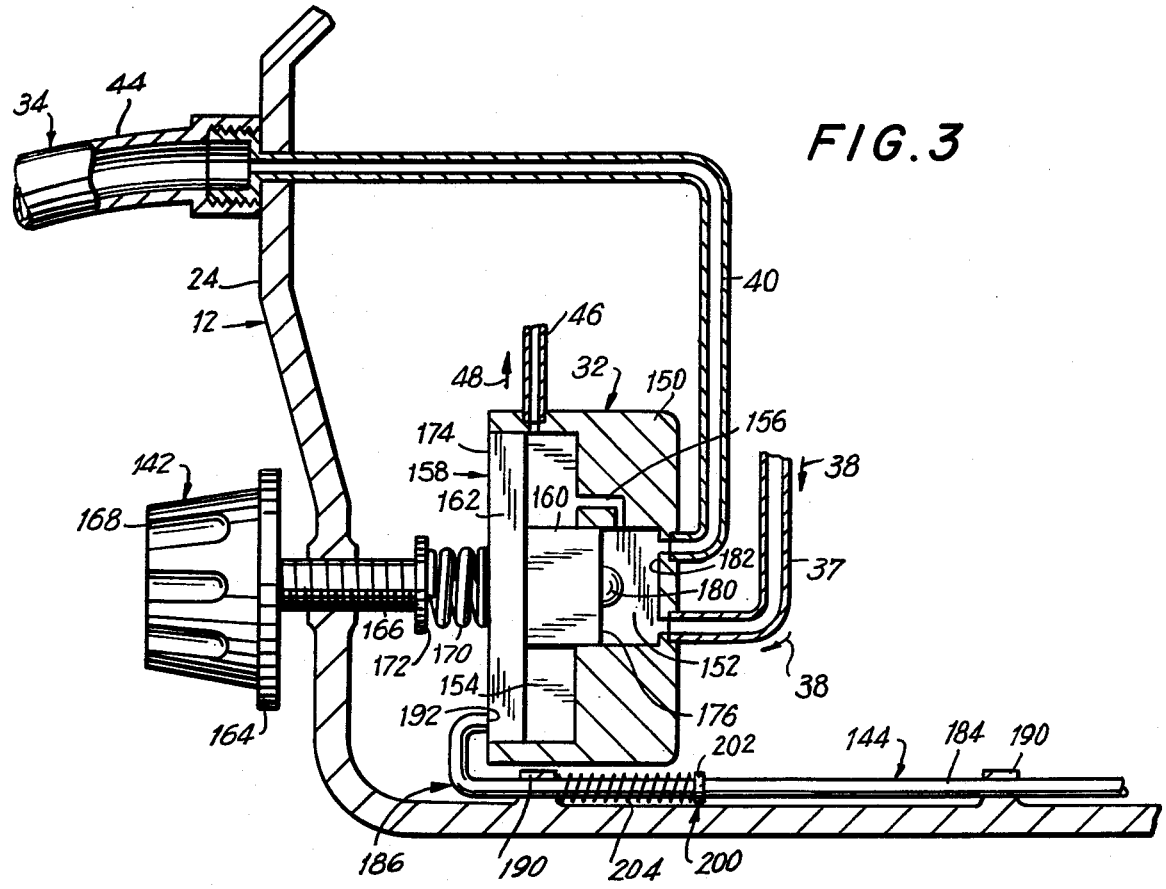
FIG. 3 is a view similar to that of FIG. 2, illustrating the valve means in its closed position, preventing air from flowing to the tire.
Figure 6:
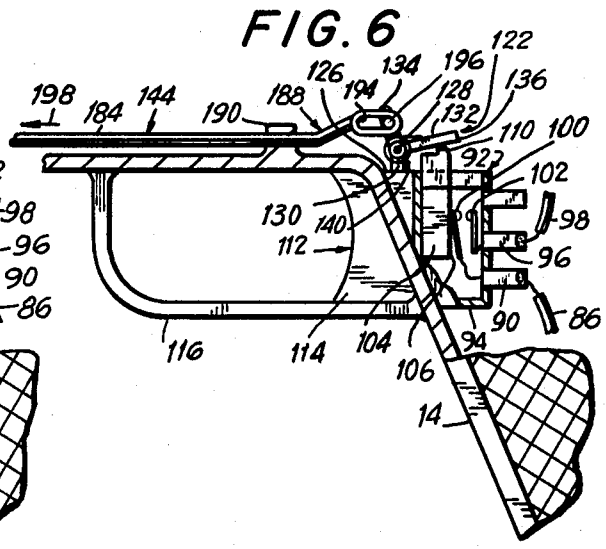
FIG. 6 is a view similar to FIG. 5 illustrating the actuating means releasing the switch means from its energized position.

An air compressor means 28 is provided and includes an electric motor 30 mounted within the cavity 22 for supplying air under pressure to the tire. The air compressor means 28 may take various forms and shapes and is to be utilized in conjunction with adjustable valve means 32 mounted on the housing 12 by a bracket or some other means (not shown). The valve means 32 is operatively connected to the compressor means 28 for selecting a predetermined air pressure for delivery to the tire. The valve means 32, as hereinafter discussed with respect to FIGS. 2 and 3, is movable between open and closed positions. The compressor means 28 is connected by a hose 34 for delivery of air under pressure to the tire. The hose 34 is provided at one end thereof with an air chuck 36 for releasable securement to the valve stem of a tire in a conventional manner.

The hose 34 is divided into respective sections. Section 37 extends from the compressor means 28 to the valve means 32 so as to provide a flow of air in the direction of arrows 38. Section 40 extends between the valve means 32 and the exterior of the housing 12. Air exiting from the valve means 32, in the open position illustrated in FIG. 2, will flow in the direction of arrows 42. An external section 44 delivers the compressed air directly to the tire by means of the air chuck 36. In the closed position of the valve means 32 air flowing in the direction of arrows 38 will not be free to exit through section 40, since section 46 is provided that is connected to atmospheric pressure which is less than the pressure in the tire or the pressure from the compressor means 28. Accordingly, the compressed air will then exit from the housing means 12 through section 46 in the direction of arrow 48.

Operatively associated with the valve means 32 is whistle means 50 which is illustrated as being mounted externally of the housing 12. The air exiting through the conduit section 46 activates the whistle to provide an audible sound when the predetermined pressure has been reached. In this manner the user of the device is immediately advised that the tire has been inflated to the pressure previously selected.

The compressor means 28 may include a cylinder 52 passing through the housing wall 16 and being partially exposed. A motor drive shaft 54 may extend from the motor 30 and have a bearing support 56. A first transmission shaft 58 is mounted on bearings 60 in the cavity 22. A first reduction gear 62 is mounted on the first transmission shaft 58 and may mesh with gear 64 on shaft 54.

A second transmission shaft 66 is mounted on bearings 68 in the housing 12. A second reduction gear 70 is mounted on the second transmission shaft 66. The second reduction gear 70 is engageable by a third gear 72 mounted on first transmission shaft 58. The compressor means 28 including a compressor 74 driven by the second transmission shaft 66 in a conventional manner. The compressor 74 having a piston rod 76 coupling same by member 78 to the second transmission shaft 66. In this manner air within the cylinder cavity 80 is continuously compressed on each reciprocation of the compressor piston head 74 with air being transmitted through section 37.

The motor 30 is electrically powered from a conventional source of electric current and may be coupled by a line cord 82 having a plug 84 at one end thereof. The cord 82 may have electric leads 86 and 88 contained therein. Lead 88 being directly connected to the terminal on the motor 30. Lead 86 is connected to a terminal 90 on switch means 92. The switch means 92 being illustrated in detail in FIGS. 4 through 6 as to the operation of the inflator 10.

Figure 5:
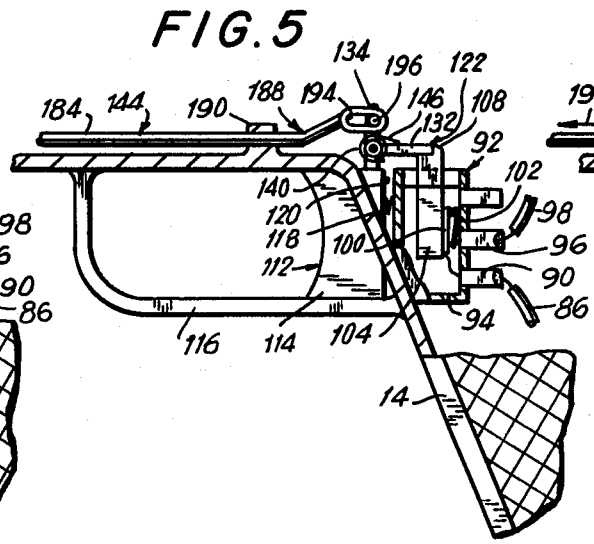
FIG. 5 is a view similar to FIG. 4 illustrating the trigger in position for closing the switch means.
Figure 4:
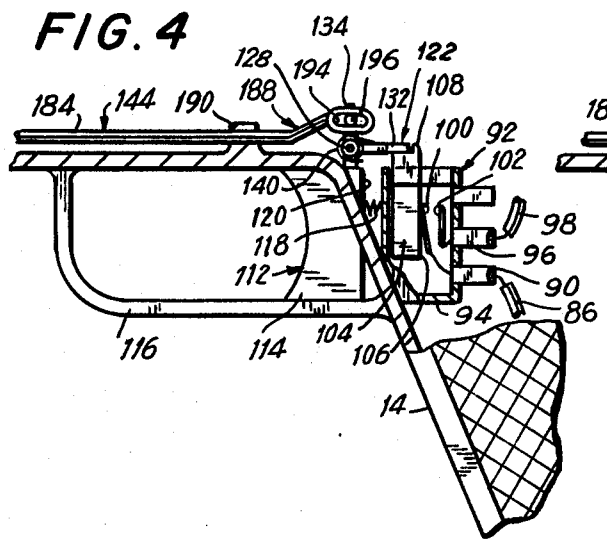
FIG. 4 is a fragmentary view, partly in section, illustrating one position of the trigger.
Figure 7:
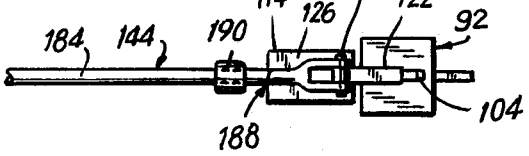
FIG. 7 is a top plan view of the portion of the device illustrated in FIG. 5.

The switch means 92 includes a casing 94 that may be fixed relative to the housing 12. Casing 94 has associated therewith a second terminal 96. Terminal 96 having lead 98 connected to the other terminal of the motor 30. In the energized position of switch means 92, as illustrated in FIG. 5, the electrical contacts 100 and 102 are in engagement with each other and electrical energy from cord 82 is transmitted for powering the motor.

In the deenergized or open positions of the switch means 92 no electrical energy is transmitted to the motor 30 and in turn the compressor means 28 ceases to function. The switch means 92 is provided with a lever 104 which is mounted within the casing 94 in a resilient manner for movement relative to contact 102. Lever 104 may be physically secured to contact 100 or otherwise mounted for reciprocal movement with respect to the positions illustrated in FIGS. 4 through 6. The lever having an inner surface 106 to be brought into abutting relationship with contact 100. The upper end 108 of lever 104 being provided with a shoulder 110.

A trigger 112 is mounted in operative relationship to switch means 92. The trigger having a trigger element 114 that is manually engageable by the user of the inflator for movement between a first position illustrated in FIG. 4, to a second position illustrated in FIG. 5. In the second position the motor 30 becomes operational and the switch means 92 is energized. The trigger element 114 is adapted for movement relative to the finger guard 116 extending outwardly from the housing 12. A spring 118 may be interposed between the casing 94 of the switch means 92 and the back end 120 of the trigger element 114, so as to urge the trigger element 114 into the first position illustrated in FIG. 4.

The trigger 112 has operatively associated a latch 122 that is pivotally mounted on the upper end 126 of the trigger element 114. The latch 122 may be mounted by pin 128 extending transversely through a bracket 130 coupled on surface 126. The latch 122 having a first arm 132 and a second arm 134 angularly displaced from each other.

The latch 122 has a free end 136 on the first arm 132. The free end 136 is designed to abut the shoulder 110 of the lever 104 in the second position illustrated in FIG. 5. A spring 140 is utilized to normally bias the latch 122 in the position illustrated in FIG. 4. In this position the contacts 100 and 102 are open and the free end 136 has not moved lever 104 to the contacting energized position illustrated in FIG. 5. The spring 140 acts for biasing the latch 122 in positional engagement with the lever 104. Accordingly, upon the user engaging the finger element 114 rearwardly moving same into the position illustrated in FIG. 5, electrical contact is made and the compressor means 28 begins to operate.

A novel feature of the present invention is that the valve means 32 is provided with regulating means 142 that is operational in conjunction with actuating means 144 to automatically disengage, or trip, latch 122 out of the position illustrated in FIG. 5. The actuating force exceeds the force applied to latch 122 by spring arm 146. When this occurs, latch 122 is brought into the position illustrated in FIG. 6 and the contacts 100 and 102 are then disengaged from each other so as to deenergize the motor 30.

The valve means 32 includes a body portion 150 mounted in fixed relationship to the housing 12 and having a first chamber 152. The first chamber 152 communicating with sections 37 and 40. A second chamber 154 is provided in the body portion 150. The chambers 152 and 154 may each have a circular cross section of differing diameters. The diameter of the first chamber 152 being smaller than the diameter of the second chamber 154 with the diameters extending coaxially with respect to each other.

An air passage 156 extends between the chambers 152 and 154. The volume of the first chamber 152 will vary with the selected pressure of the regulating means 142. Piston means 158 is mounted within the chambers 152 and 154. The piston means 158 includes one section 160 extending in the first chamber 152 and another section 162 extending within the second chamber 154. The piston means 158 being movable axially relative to the chambers 152 and 154, between the open and closed positions of the valve means 32.

The open position illustrated in FIG. 2, permits air entering the first chamber 152 from the compressor means 28 to exit into the hose section 40 for delivery to the tire. In the closed position illustrated in FIG. 3, the entering air through section 37 is now permitted to exit through air passage 156, via chamber 154 and through the outlet section 46.

The regulating means 142 is operatively associated with the piston means 158 to select the predetermined pressure. The regulating means may include a dial 164 extending exteriorly of the housing 12. The dial 164 may be calibrated in terms of pounds of pressure at which the regulating means will permit the release of the piston means 158. The piston means 158 extending in the closed position above the predetermined pressure and in the open position below the predetermined pressure.

The regulating means 142 includes a shaft 166 having a knob 168 secured at one end thereof. The shaft 166 is threadably mounted relative to the front 24 of the housing 12. A spring 170 extends between one end 172 of shaft 166 and the outer end 174 of piston means 158.

Accordingly, the spring 170 is selected, and the dial 164 calibrated such that when the pressure within the first chamber 152 reaches the predetermined pressure, the piston means 158 is automatically urged rearwardly from the position illustrated in FIG. 2 to that illustrated in FIG. 3. The piston means 158 having a front end 176 in oppositely disposed relationship to the rear end 174. Stop means 180, in the form of a protrusion, extends outwardly from the front end 176. The stop means 180 engaging the wall 182 of the first chamber 152, to limit the travel of the valve means 32 in the open position. In this manner even when the regulating means 142 is adjusted, there will always be a flow passage for air around the stop means 180. In this way air may flow from section 37 to section 40 in a continuous path.

The spring 170 applies pressure of a predetermined force against the piston means 158. When movement occurs, the piston means 158 is brought into engagement with the actuating means 144. The actuating means 144 comprises an elongated linkage member 184 having oppositely disposed forward and rearward ends 186 and 188, respectively. Supporting means 190 may be provided within the housing 12 for mounting of the linkage member 144 so as to permit reciprocal movement thereof. The forward end 186 may include a distal end 192 formed to abut the rear end 174 of piston means 158. The rearward end 188 of the lingage member 184 being operatively coupled to the latch 122. The rearward end 188 may include a grooved section or sleeve 194 having a pin 196 extending within the sleeve 194. The pin 196 is coupled to the second arm 134 of latch 122.

The linkage member 184 is displaced in the direction of arrow 198 when the piston means 158 moves from the position of FIG. 2 to the position of FIG. 3. This displacement is sufficient to obtain angular rotation of latch 122 by pin 196 being engaged at one end of sleeve 194 and rotating the second arm 134. This rotation also rotates first arm 132 such that the free end 136 is disengaged from shoulder 110 and the lever 104 is automatically returned to a forward position thereby disengaging electrical contact 100 and 102. The trigger element 114 may at this moment still be in its second position until the finger of the user is removed therefrom. When the finger is removed, spring 118 displaces the finger element 114 to the position illustrated in FIG. 4.

To prevent inadvertent movement of the linkage member 184, retaining means 200 is provided. Retaining means 200 may include a shoulder 202 and a spring 204 extending between the shoulder 202 and mounting means 190. This provides a releasably fixed relationship of the linkage member 184 to the switch means 92 and the valve means 32.

Accordingly, the operator of the bicycle tire inflator 10 utilizes the device by first rotating the knob 168 of the regulating means 142 until the appropriate number on a scale (not shown) appearing on the front 24 of the housing is reached. This action upon the part of the operator sets the preload on spring 170 to a desired pressure. Upon application of finger pressure to trigger element 114, there is movement by the latch 132 against lever 104 such as to close switch means 32 and energize the motor 30.

Pressure developed in the compressor means 28 starts to flow through tube section 37 into the smaller first chamber 152. The air flow passes into section 40 and in turn section 44 of the delivery hose 34 and through chuck 36 into the tire being inflated. As pressure being delivered to the tire begins to rise, the expansive force of the air contained in the smaller chamber 152 increases.

Slowly at first, piston means 158 begins to move outward in the bore of body 150, as the preselected counter-force of spring 170 is gradually overcome. At the point when the force exerted by air pressure on the head area of the smaller diameter 176 of piston section 160 equals the counter-force which has been "programmed" into spring 170 by the selective indexing of knob 168, the sharp edge of the smaller diameter of piston section 16 uncovers the leading edge of passage 156.

At this instant several actions occur, to all intent and purposes simultaneously. Highly pressurized air from the smaller chamber 152 enters passage 156 and flows into the larger chamber 154. Acting upon the much greater surface area of the larger diameter of piston section 160 which is within larger chamber 154, the pressurized air exerts a sudden and greatly increased force upon piston means 158, moving piston means 158 outward in the bore and collapsing spring 170.

As the piston means 158 moves outward a short distance, the rear end 174 will engage the distal end 192 of the linkage member 184. In addition, a volume of air flows through tube section 46 to warning whistle 50, causing a loud chirp or blast of short duration.

Piston means 158, in its moving outward in the seat provided, has caused yet another action. It has also contacted, and forced forward a short distance, the forward hooked end 192 of tripping rod or linkage member 184. The linkage member 184, by means of slotted yoke section 194 on its rearward end 188, has tripped latch 122, disengaging latch 122 from switch actuating lever 104, and allowing spring loaded switch means 92 to return to the open position. Motor 30 shuts off, the load of compressor 28 bringing it to a full stop within a few revolutions.

Under the thrust of spring 170, piston means 158 immediately retreats into the cavity, protected against any "slamming" action by the cushioning effect of the volume of pressurized air contained in the smaller chamber 152. Loss of the air which has been forced into the tire is prevented by the action of the valve in the tire.

Upon the tripping of latch 122, the trigger element 114, being freed of the resistance of switch means 92, and still under the pressure of the operator's finger, overcomes the slight remaining resistance of trigger return spring 118, and moves to its rearmost "slack" position.

This sequence of events cannot be initiated again until finger pressure has been completely removed from trigger element 114. Trigger element 114 will then be moved forward by trigger return spring 118 to its fully released position, said forward movement reestablishing the horizontal attitude of latch 122 and enabling the engagement of latch 122 with switch actuating lever 104 for subsequent use.

The dimensional relationship of the various components may be selected to obtain the desired movements of the various interrelated parts. The linkage member 184 may have an opening within the sleeve 194 that requires minimal longitudinal displacement to engage pin 196 and free latch 122 from its normal horizontal position, as illustrated in FIG. 5. In the inclined position of FIG. 6 lever 104 is released.

Although an illustrative embodiment of the invention has been described in detail herein with reference to the accompanying drawings, it is to be understood that the invention is not limited to the precise embodiment and that various changes and modifications may be effected therein without departing from the scope or spirit of the invention.

What is claimed is:

1. An inflator for tires, comprising a housing, adapted to be hand held, air compressor means including an electric motor mounted in said housing for supplying air under pressure to a tire, adjustable valve means mounted on said housing and operatively connected to said compressor means for selecting a predetermined air pressure for delivery to the tire, said valve means movable between open and closed positions, a hose operatively connected to said valve means to provide air under pressure for delivery to the tire from said compressor means in said open position of said valve means, switch means mounted in said housing and coupled to said motor for supplying electrical energy to said motor in the energized position of said switch means, and actuating means operatively associated with said valve means and said switch means, said actuating means releasing said switch means from its energized position when said closed position of said valve means is obtained when a predetermined pressure is reached in said valve means, such that the supply of compressed air to the tire ceases.

2. An inflator for tires in accordance with claim 1, including regulating means operatively associated with said valve means to select said predetermined pressure for delivery to the tire.

3. An inflator for tires in accordance with claim 2, said regulating means including a dial extending exteriorly of said housing.

4. An inflator for tires in accordance with claim 1, including whistle means operatively associated with said valve means, said whistle means activated when said predetermined pressure has been reached.

5. An inflator for tires in accordance with claim 1, including a trigger mounted on said housing and manually engageable by the user of the inflator for movement between a first and second position, said trigger mechanically connected to said switch means and movable from said first position to said second position, said switch means being energized in said second position, and said actuating means releasing said trigger from said second position to said first position when said predetermined pressure is reached.

6. An inflator for tires in accordance with claim 1, wherein said switch means includes a line cord connected through said housing to provide electrical energy.

7. An inflator for tires in accordance with claim 1, including an air chuck connected to said hose for releasable securement to the tire.

8. An inflator for tires in accordance with claim 1, said valve means comprising a body portion mounted in fixed relationship to said housing, a first chamber in said body portion, said first chamber communicating with said compressor means and said hose, a second chamber in said body portion, an airway passage extending between said chambers, piston means including one section extending in said first chamber, and another section in said second chamber, said piston means being movable axially relative to said chambers between said open and closed postions of said valve means, said open position permitting air entering said first chamber from said compressor means to exit into said hose for delivery to the tire, said closed position permitting air entering said first chamber to flow through said airway passage and into said second chamber, regulating means operatively associated with said piston means to select said predetermined pressure, said piston means extending in said closed position above said predetermined pressure, and said piston means extending in said open position below said predetermined pressure.

9. An inflator for tires in accordance with claim 8, wherein said regulating means comprises a shaft having a knob at one end threadably mounted relative to said housing, a spring extending from the other end of said shaft for applying a biasing force against said piston means, and said biasing force being predetermined relative to the force required to move said piston means between said positions.

10. An inflator for tires in accordance with claim 8, wherein said volume of said first chamber varies with the selected pressure of said regulating means.

11. An inflator for tires in accordance with claim 8, wherein said chambers each have a circular cross-section of differing diameters, said diameter of said first chamber being smaller than the diameter of said second chamber, and said diameters extending co-axially with respect to each other.

12. An inflator for tires in accordance with claim 8, said piston means having an oppositely disposed rear end and a front end, said front end extending within said first chamber, stop means extending outwardly from said front end for engaging a wall of said body portion to limit the travel of said valve means in said open position, and said regulating means being engageable with said rear end.

13. An inflator for tires in accordance with claim 1, wherein said compressor means comprises a motor drive shaft extending from said motor, a first transmission shaft mounted on bearings in said housing, a first reduction gear mounted on said first transmission shaft driven by said motor shaft, a second transmission shaft mounted on bearings in said housing, a second reduction gear mounted on said second transmission shaft, said second reduction gear engageable by a third gear mounted on said first transmission shaft for driving same, and said compressor means including a compressor driven by said second transmission shaft.

14. An inflator for tires in accordance with claim 13, said compressor including a cylinder passing through said housing and partially exposed.

15. An inflator for tires in accordance with claim 1, said actuating means comprises an elongated linkage member having oppositely disposed forward and rearward ends, means for supporting said linkage member in said housing for movement therein, said forward end of said linkage member operatively associated with said valve means, said rearward end of said linkage member operatively associated with said switch means, and said linkage member being displaced by movement of said valve means from said open to said closed position, so as to release said switch means from its energized position such that said compressor means stops.

16. An inflator for tires in accordance with claim 15, wherein said valve means includes piston means movable between said open position and said closed position, and said forward end being engageable by said piston means as the latter moves from said open position to said closed position.

17. An inflator for tires in accordance with claim 15, wherein said switch means is mounted in fixed relation to said housing, said switch means including a lever extending therefrom and resiliently mounted for movement relative to said switch means, said lever in one position maintains said switch means in an energized condition and in another position in a deenergized condition, a latch pivotally mounted relative to said switch means for engagement with said lever, and said latch operatively connected to said rearward end of said linkage member and to said lever, so as to obtain release of said lever to deenergize said compressor means concurrently with the movement of said valve means from said open position to said closed position.

18. An inflator for tires in accordance with claim 17, including a trigger mounted on said housing and manually engageable by the user of the inflator for movement between a first and second position, said trigger mechanically connected to said switch means and movable from said first position to said second position, said switch means being energized in said second position, and said actuating means releasing said trigger from said second position when said predetermined pressure is reached.

19. An inflator for tires in accordance with claim 18, said latch being pivotally mounted on said trigger, said latch being in engagement with said lever in said second position of said trigger so as to energize said switch means, and said latch releasing said lever by means of said linkage member when said valve means moves from said open position to said closed position.

20. An inflator for tires in accordance with claim 19, including menas for biasing said latch in positional engagement with said lever.

21. An inflator for tires in accordance with claim 19, said lever having a shoulder to engage said latch in abutting relationship, and said lever forming part of the mounting for the electrical contacts of said switch means.

22. An inflator for tires in accordance with claim 19, including means for retaining said linkage member in releasably fixed relationship relative to said switch means.

23. An inflator for tires, comprising a housing, adapted to be hand held, air compressor means including an electric motor mounted in said housing for supplying air under pressure to a tire, adjustable valve means mounted on said housing and operatively connected to said compressor means for selecting a predetermined air pressure for delivery to the tire, said valve means movable between open and closed positions, a hose operatively connected to said valve means to provide air under pressure for delivery to the tire from said compressor means in said open position of said valve means, regulating means operatively associated with said valve means to select said predetermined pressure for delivery to the tire, switch means mounted in said housing and coupled to said motor for supplying electrical energy to said motor in the energized position of said switch means, a trigger mounted on said housing and manually engageable by the user of the inflator for movement between a first and second position, said trigger mechanically linked to said switch means and movable from said first position to said second position, said switch means being energized in said second position, and actuating means operatively associated with said valve means, said trigger and said switch means, said actuating means releasing said trigger from said second position when said closed position of said valve means is obtained, such that when said predetermined pressure is reached in said valve means the supply of compressed air to the tire ceases.

24. An inflator for tires in accordance with claim 23, said regulating means including a dial extending exteriorly of said housing.

25. An inflator for tires in accordance with claim 23, including whistle means operatively associated with said valve means, said whistle means activated when said predetermined pressure has been reached.

26. An inflator for tires in accordance with claim 23, said valve means comprising a body portion mounted in fixed relationship to said housing, a first chamber in said body portion, said first chamber communicating with said compressor means and said hose, a second chamber in said body portion, an airway passage extending between said chambers, piston means including one section extending in said first chamber, and another section in said second chamber, said piston means being movable axially relative to said chambers between said open and closed positions of said valve means, said open position permitting air entering said first chamber from said compressor means to exit into said hose for delivery to the tire, said closed position permitting air entering said first chamber to flow through said airway passage and into said second chamber, regulating means operatively associated with said piston means to select said predetermined pressure, said piston means extending in said closed position above said predetermined pressure, and said piston means extending in said open position below said predetermined pressure.

27. An inflator for tires in accordance with claim 26, wherein said regulating means comprises a shaft having a knob at one end threadably mounted relative to said housing, a spring extending from the other end of said shaft for applying a biasing force against said piston means, said biasing force being predetermined relative to the force required to move said piston means between said positions, and said volume of said first chamber varies with the selected pressure of said regulating means.

28. An inflator for tires in accordance with claim 27, wherein said chambers each have a circular cross-section of differing diameters, said diameter of said first chamber being smaller than the diameter of said second chamber, and said diameters extending co-axially with respect to each other.

29. An inflator for tires in accordance with claim 26, said piston means having an oppositely disposed rear end and a front end, said front end extending within said first chamber, stop means extending outwardly from said front end for engaging a wall of said body portion to limit the travel of said valve means in said open position, and said regulating means being engageable with said rear end.

30. An inflator for tires in accordance with claim 23, said actuating means comprises an elongated linkage member having oppositely disposed forward and rearward ends, means for supporting said linkage member in said housing for movement therein, said forward end of said linkage member operatively associated with said valve means, said rearward end of said linkage member operatively associated with said switch means, said linkage member being displaced by movement of said valve means from said open to said closed position, so as to release said switch means from its energized position such that said compressor means stops, said valve means includes piston means movable between said open position and said closed position, and said forward end being engageable by said piston means as the latter moves from said open position to said closed position.

31. An inflator for tires in accordance with claim 30, wherein said switch means is mounted in fixed relation to said housing, said switch means including a lever extending therefrom and resiliently mounted for movement relative to said switch means, said lever in said second position of said trigger maintaining said lever in a deflected position such that said switch means is energized, a latch pivotally mounted on said trigger for movement relative to said switch means for engagement with said lever, and said latch operatively connected to said rearward end of said linkage member and to said lever, so as to obtain release of said lever from said second position of said trigger to deenergize said compressor means concurrently with the movement of said valve means from said open position to said closed position.

32. An inflator for tires in accordance with claim 31, said latch being in engagement with said lever in said second position of said trigger so as to energize said switch means, means for biasing said latch in positional engagement with said lever, said lever having a shoulder to engage said latch in abutting relationship, and said lever forming part of the mounting for the electrical contacts of said switch means.

* * * * *

UNITED STATES PATENT OFFICE

CERTIFICATE OF CORRECTION

Patent No. 4,080,105 Dated March 21, 1978

Inventor(s) Edwin E. Connell

It is certified that error appears in the above-identified patent and that said Letters Patent are hereby corrected as shown below:

Column 11, line 9, claim 20, "menas" should read -- means --.

Signed and Sealed this

*Fourth* Day of *July 1978*

[SEAL]

*Attest:*

RUTH C. MASON
*Attesting Officer*

DONALD W. BANNER
*Commissioner of Patents and Trademarks*